US009850585B1

(12) United States Patent
Zidan

(10) Patent No.: US 9,850,585 B1
(45) Date of Patent: Dec. 26, 2017

(54) ENHANCING ELECTROCHEMICAL METHODS FOR PRODUCING AND REGENERATING ALANE BY USING ELECTROCHEMICAL CATALYTIC ADDITIVE

(75) Inventor: Ragaiy Zidan, Aiken, SC (US)

(73) Assignee: SAVANNAH RIVER NUCLEAR SOLUTIONS, LLC, Aiken, SC (US)

( * ) Notice: Subject to any disclaimer, the term of this patent is extended or adjusted under 35 U.S.C. 154(b) by 0 days.

(21) Appl. No.: 13/136,864

(22) Filed: Aug. 12, 2011

Related U.S. Application Data

(63) Continuation-in-part of application No. 11/891,125, filed on Aug. 9, 2007, now Pat. No. 8,470,156.

(60) Provisional application No. 61/401,379, filed on Aug. 12, 2010.

(51) Int. Cl.
*C25B 1/00* (2006.01)

(52) U.S. Cl.
CPC ..... *C25B 1/00* (2013.01)

(58) Field of Classification Search
CPC ..... C25B 1/00
USPC ..... 205/477; 423/644, 645
See application file for complete search history.

(56) References Cited

U.S. PATENT DOCUMENTS

| | | | | |
|---|---|---|---|---|
| 3,556,740 | A * | 1/1971 | Murib | 423/644 |
| 3,764,666 | A * | 10/1973 | Murib | 423/645 |
| 6,471,935 | B2 | 10/2002 | Jensen et al. | |
| 6,617,064 | B2 | 9/2003 | Petrie et al. | |
| 6,686,076 | B2 | 2/2004 | Johnson | |
| 7,153,489 | B2 | 12/2006 | Bingham et al. | |
| 7,521,037 | B1 * | 4/2009 | Graetz et al. | 423/645 |
| 2004/0009392 | A1 | 1/2004 | Petillo et al. | |
| 2006/0102489 | A1 | 5/2006 | Kelly | |
| 2009/0038954 | A1 | 2/2009 | Zidan | |
| 2010/0252444 | A1 | 10/2010 | Vajo et al. | |

FOREIGN PATENT DOCUMENTS

| | | | |
|---|---|---|---|
| DE | 11 41 623 B | 12/1962 | |
| WO | WO 01/78170 | 10/2001 | |
| WO | WO 03/058748 | 7/2003 | |
| WO | WO 05/090229 | 9/2005 | |
| WO | WO 05/097491 | 10/2005 | |
| WO | WO 06/050077 | 5/2006 | |
| WO | WO 06/101214 | 9/2006 | |
| WO | WO 06/114728 | 11/2006 | |
| WO | WO 2007/112203 | 10/2007 | |
| WO | WO 2009/054874 | 4/2009 | |
| WO | WO 2009054874 A2 * | 4/2009 | C25B 1/00 |

OTHER PUBLICATIONS

Gorrell, I.B.; Hitchcock, P.B.; and Smith, J.D. "Preparation and crystal structures of aluminium hydride adducts with tetrahydrofuran [AlH3•OC4H8]2 and AlH3•2OC4H8." Jan. 1, 1993. Journal of the Chemical Society, Chemical Communications. (1993) Issue 2. pp. 189-190.*

Wegrzyn, J.; Graetz, J.; Reilly, J.; and Johnson, J. "Synthesis and properties of aluminum hydride as a hydrogen storage material." May 23, 2005. Presentation from Department of Energy 2005 Hydrogen Program Annual Review.*

Senoh, H., Kiyobayashi, T., Kuriyama, N. "Hydrogen electrode reaction of lithium and soidum aluminum hydrides." International Journal of Hydrogen Energy. Jun. 2008. vol. 33, Issue 12. pp. 3178-3181.*

Pagni, Richard. "Catalysis and Catalysts." Chemistry Explained. Feb. 6, 2010 capture of <http://www.chemistryexplained.com/Bo-Ce/Catalysis-and-Catalysts.html> using WayBack Machine Internet Archive.*

General Chemistry Online. Glossary. Retrieved from <http://antoine.frostburg.edu/chem/senese/101/glossary/e.shtml> on Feb. 17, 2017.*

Chemistry-Dictionary.com. "Electrolyte" entry. Retrieved from <http://chemistry-dictionary.com/definition/electrolyte.html> on Feb. 17, 2017.*

Bogdanovic & Schwickardi, "Ti-doped Alkali Metal Aluminum Hydrides as Potential Novel Reversible Hydrogen Storage Materials," Journal of Alloys and Compounds, vol. 253-254, 1997, p. 1-9.

Jensen et al, "Advanced Titanium Doping of Sodium Aluminum Hydride: Segue to a Practical Hydrogen Storage Material?" Hydrogen Engery, vol. 24, 1999, p. 461-465.

Zidan et al, "Hydrogen Cycling Behavior of Zirconium and Titanium-Zirconium-Doped Sodium Aluminum Hydride," Journal of Alloys and Compounds, vol. 285, 1999, p. 119-122.

Bogdanovic et al, "Metal-doped Sodium Aluminium Hydrides as Potential New Hydrogen Storage Materials," Journal of Alloys and Compounds, vol. 302, 2000, p. 36-58.

H. Senoh et al: "Electrochemical reaction of lithium alanate dissolved in diethyl ether and tetrahydrofuran", J. Power Sources vol. 164, Nov. 17, 2006 (Nov. 17, 2006), pp. 94-99, XP002527187 paragraph [0004]; table 1.

European Patent Office, International Search Report, PCT/US2008/009536, dated Jun. 4, 2009, Rijswijk, NL, 7 pages.

European Patent Office, Written Opinion, PCT/US2008/009536, dated Jun. 4, 2009, Munich, DE, 7 pages.

(Continued)

*Primary Examiner* — Steven A. Friday

(74) *Attorney, Agent, or Firm* — J. Bennett Mullinax, LLC

(57) ABSTRACT

A process of using an electrochemical cell to generate aluminum hydride ($AlH_3$) and other high capacity hydrides is provided. The electrolytic cell uses an electro-catalytic-additive within a polar non-salt containing solvent to solubilize an ionic hydride such as $NaAlH_4$ or $LiAlH_4$. The resulting electrochemical process results in the formation of $AlH_3$ adduct. $AlH_3$ is obtained from the adduct by heating under vacuum. The $AlH_3$ can be recovered and used as a source of hydrogen for the automotive industry. The resulting spent aluminum can be regenerated into $NaAlH_4$ or $LiAlH_4$ as part of a closed loop process of $AlH_3$ generation.

10 Claims, 10 Drawing Sheets

(56) References Cited

OTHER PUBLICATIONS

Alpatova, N. M. et al, "Physicochemical Properties and Structure of Complex Compounds of Aluminium Hydride", Russian Checmial Reviews, 37 (2), 1968, Institute of Electrochemistry, Academy of Scienses of the USSR, Kurnakov Institute of General and Inorganic Chemicstry, Academy of Sciences, Moscow, pp. 99-114.

* cited by examiner

M=Na, Li, K..

ECC = Electrochemical Cell
V = Vacuum Pump

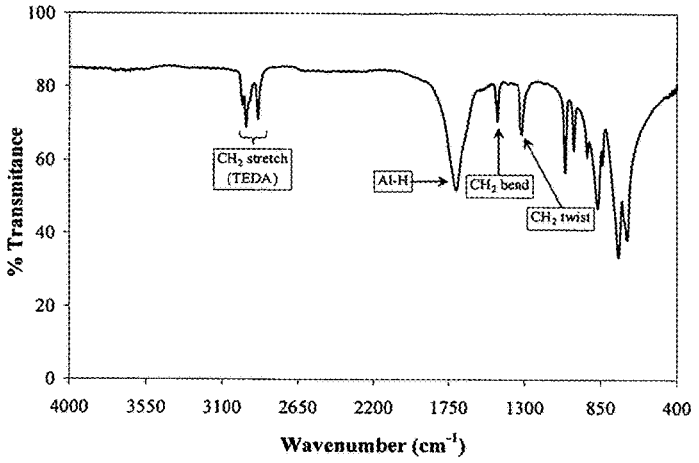
Fig. 10: IR spectra of $AlH_3$-TEDA product from the electrochemical cell of $LiAlH_4$-$Et_2O$.

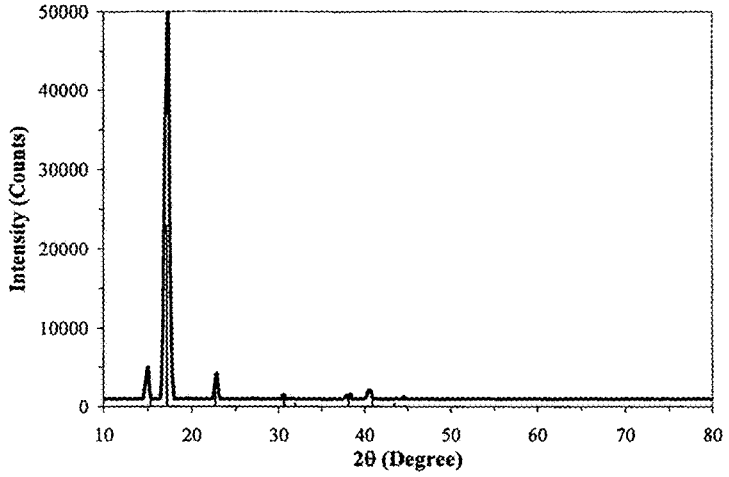
Fig. 11: XRD of $AlH_3$-TEDA product from the electrochemical cell of $LiAlH_4$-$Et_2O$.

ENHANCING ELECTROCHEMICAL METHODS FOR PRODUCING AND REGENERATING ALANE BY USING ELECTROCHEMICAL CATALYTIC ADDITIVE

RELATED APPLICATIONS

This application claims the benefit of U.S. Provisional Application 61/401,379 filed on Aug. 12, 2010 and which is incorporated herein by reference.

STATEMENT AS TO RIGHTS TO INVENTIONS MADE UNDER FEDERALLY SPONSORED RESEARCH AND DEVELOPMENT

This invention was made with Government support under Contract No. DE-AC09-085R22470 awarded by the United States Department of Energy. The Government has certain rights in the invention.

FIELD OF THE INVENTION

This invention is directed towards use of electrochemical cells to generate aluminum hydride ($AlH_3$) and other high hydrogen capacity complex hydrides. The ability to produce the $AlH_3$ in an electrolytic cell allows the possibility of creating a reversible alane product in a cost effective manner which avoids the formation of unused or unwanted byproducts. Other hydrides such as $Mg(AlH_4)_2$ and $Ca(AlH_4)_2$ can be formed by varying the electrodes and/or the electrolyte present within the electrolytic cell. For instance, the same principle can be used to form Borohydride Complexes such as $Al(BH_4)_3$.

The invention is further directed to an alane formation using an electrolytic cell which uses polar and other similar organic solvents that allow the use of more efficient higher temperatures for the electrolytic process.

The invention is further directed to an electrolytic process of forming metal hydrides using polar solvents which can be carried out under elevated pressures to facilitate favorable reactions.

BACKGROUND OF THE INVENTION $AlH_3$ has great potential as a source of hydrogen for fuel cells and other technologies. $AlH_3$ is made out of aluminum, which is relatively inexpensive, and has a high weight percent hydrogen when hydrided. Heretofore, the ability to regenerate the aluminum metal back into aluminum hydride has proven too expensive for large scale commercial use.

For instance, $AlH_3$ can be formed using high pressure conditions such as $10^5$ bars hydrogen pressure at room temperatures. While such conditions can be achieved in laboratory and small scale demonstration conditions, the high pressures, competing reactions, and overall energy budget have prevented high pressure alane formation from being widely considered for production of alanes for a hydrogen fuel cell.

Additional conditions for alane formation require plasma conditions or the use of non-economical chemical reactions. Under all these conditions, there are competing reactions that can lead to unstable phases of alane formation and hence generation of an end product that is unsuitable for large scale commercial production of alanes which is needed for fuel cells in the automotive industry.

Accordingly, there remains room for improvement and variation within the art.

SUMMARY OF THE INVENTION

It is one aspect of at least one of the present embodiments to provide for an electrochemical cell using an organic solvent that allows the formation of $AlH_3$ and other high hydrogen capacity complex hydrides in a cost effective manner.

It is a further aspect of at least one of the present embodiments of the invention to provide for an electrochemical cell in which alanates such as NaAlH4 or $LiAlH_4$, in combination with a polar solvent such as THF allows for the direct formation of an alane—THF adduct ($AlH_3$:THF)

It is another aspect of at least one of the present embodiments to provide for an electrochemical cell for the production of $AlH_3$ using $LiAlH_4$ or $NaAlH_4$ dissolved in a polar solvent and using one of at least an elevated pressure or an elevated temperature in order to increase the efficiency of the $AlH_3$ adduct production. The adduct can be crystallized later by heating and under low pressure to form pure alane.

It is a further aspect of at least one of the present embodiments to provide for the production of $AlH_3$ which can be used as a source of hydrogen for use in a vehicle. The resulting aluminum metal can be mixed in solid state or in solvent with NaH or LiH and hydrided using titanium catalyst. The LiH or NaH can subsequently combine with the aluminum metal in a direct hydrogenation to yield $LiAlH_4$ or $NaAlH_4$. The $LiAlH_4$ or the $NaAlH_4$ is used in an electrochemical cell to produce $AlH_3$ via a $AlH_3$ adduct. The resulting cyclic production of $AlH_3$ is a closed process in which no byproducts are generated. The same process can apply to other ionic complex hydrides such as $Ca(AlH_4)_2$ and $KAlH_4$.

It is another aspect of at least one embodiment of the present invention to provide for a reversible alane formation in which $AlH_3$ can be used as a source of hydrogen in which the resulting aluminum metal can be hydrogenated in the presence of LiH or NaH to provide $LiAlH_4$ or $NaAlH_4$. Using an electrolytic cell, the LiAlH4 or $NaAlH_4$ may be used to regenerate the $AlH_3$. In the case of $NaAlH_4$ the sodium and hydrogen ions produced in the electrochemical cell may be reused in the direct hydrogenation of aluminum metal to regenerate the $NaAlH_4$. $KAlH_4$ or $LiAlH_4$ dissolved in polar solvent such as THF may also be used as a suitable non-aqueous electrolyte since $LiAlH_4$ and $KAlH_4$ may be regenerated in a manner similar to $NaAlH_4$ It is yet another aspect of at least one of the present embodiments to provide for a cost effective, reusable process that permits the use of $AlH_3$ as a hydrogen source with the aluminum metal being recharged into a $NaAlH_4$.

It is yet another aspect of at least one of the present embodiments to use an electrolytic cell having an electrolyte selected from the group consisting of $NaAlH_4$, $KAlH_4$, $LiAlH_4$ (and other similar alanates), triethylenediamine (and other similar amines), aluminum etherates, borohydride adducts, and combinations thereof to generate an organometallic hydride by passing current through the electrochemical cell.

It is yet another aspect of at least one of present embodiments to provide a process of using an electrolytic cell to form adducts of hydrogen storage materials using an electrolytic cell.

The invention is further directed to an electrolytic process for producing and regenerating alane as a use of a catalytic additive of a halide of the formula MX where M=Li, or Na and X=F, Cl, Br and I.

It is at least one aspect of one of present embodiments in the invention to provide an additive within an electrolyte solution used for the production of an alane in which an (ECA) is added which has a catalytic effect on a subsequent reaction, the reaction being independent of any effect on resistance or conductivity of the electrolyte.

This invention is further directed to an electrochemical process of producing $AlH_3$ comprising: supplying an anode; supplying a cathode; placing the anode and the cathode in an electrolytic solution comprising THF and $NaAlH_4$, $LiAlH_4$, $KHAl_4$ or any similar ionic solution, the electrolytic solution further comprising an electro-catalytic-additive; passing a current through the electrochemical cell thereby forming $AlH_3$.

This invention is further directed to an electrochemical process of producing $AlH_3$ comprising: supplying an anode selected from the materials of palladium, titanium, zirconium, aluminum, magnesium, calcium, or hydride forming metals; supplying a cathode selected from platinum or a metallic hydride; placing the anode and the cathode in an electrolytic solution comprising an electro-catalytic-additive and further containing $LiAlH_4$, said $LiAlH_4$ formed from direct hydrogenation of aluminum, the aluminum being recovered from dehydrided $AlH_3$; passing a current through the electrochemical cell thereby forming $AlH_3$ adduct; and, heating the $AlH_3$ adduct in a vacuum and thereby recovering $AlH_3$.

This invention is further directed to an electrochemical process of producing an alane comprising: supplying an anode selected from the materials of palladium, titanium, zirconium, aluminum, magnesium, calcium, and combinations thereof; supplying a cathode selected from the materials of platinum, a metallic hydride, and combinations thereof; placing the anode and the cathode in an electrolytic solution comprising an electro-catalytic-additive and further containing an electrolyte selected from the group consisting of $NaAlH_4$, $LiAlH_4$, $KAlH_4$, triethylenediamines, aluminum etherates, borohydrides, and combinations thereof; and, passing a current through the electrochemical cell thereby forming at least one of a metal hydride or metal hydride adduct.

This invention is further directed to a process that may use an electrolytic solution that is formed from a dehydrided metal hydride. Additionally, when the cathode is platinum, atomization of hydrogen occurs at the cathode.

The process may use an electrode-catalytic additive which is a halide according to the formula MX where M is Li or Na and X is F, Cl, Br, or I.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

FIG. 10 is an IR spectra of $AlH_3$-TEDA product from the electrochemical cell of $LiAlH_4$-$Et_2O$.

FIG. 11 is an X-ray diffraction analysis graph of $AlH_3$-TEDA product from the electrochemical cell of $LiAlH_4$-$Et_2O$.

DESCRIPTION OF THE PREFERRED EMBODIMENT

Figure 1:
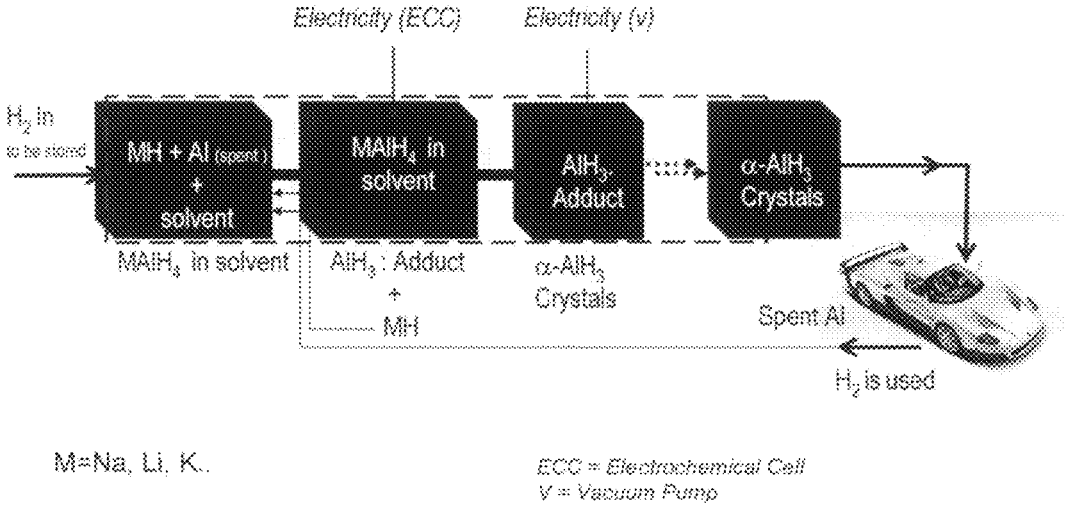
FIG. 1 is a schematic diagram describing the process of a reversible alane formation.

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers. The methodology described herein relates to an electrochemical process described in U.S. application Ser. No. 11/891,125 filed on Aug. 9, 2007 and to PCT Application No. PCT/US2008/009536 filed Aug. 8, 2008, both of which are incorporated herein by reference.

In accordance with the present invention, it has been found that a complex hydride such as $NaAlH_4$, $LiAlH_4$, or $KAlH_4$ may be dissolved in the polar solvent such as THF within an electrolytic cell. The use of an organic solvent prevents the oxidation of the product and allows for the dissolving of the product which would interfere with the desired reaction. The reaction products may be recovered later. Using a cathode of platinum and an anode of aluminum results in the electrolytic formation of $AlH_3$ adduct. The adduct allows recovery of $AlH_3$ by heating under a vacuum. While the $AlH_3$ adduct will tend to accumulate on the anode, it has been found that mixing ether with the THF or adding more THF solvent will dissolve the $AlH_3$ adduct from the anode and allow the reaction to continue. The aluminum hydride can be crystallized and separated later from adduct by evaporating the solvent under vacuum. Preferably, when solvent is heated to a temperature of between 70 and 80 degrees centigrade in order to form alpha alane. Although other alane phases can be formed by means of varying temperature used in separation from the adduct alpha alane formed using electrochemistry is most desired for its stability. Alternatively, it is envisioned that a mechanical scraper, ultrasonic vibration, or similar processes can be used to periodically or continuously remove the deposited $AlH_3$ from the anode. However, it is believed that direct formation of $AlH_3$ is not desired in that the crystallization from an adduct is needed in order to bring about stabilization of the resulting alane molecule.

The electrolytic conditions can be varied to bring about a more efficient production of $AlH_3$. For instance, operating the electrolytic process under high pressure will facilitate the reaction speed. Likewise, using the electrolytic process at high temperatures will also favor a more rapid and efficient reaction rate of $AlH_3$ production. Since the electrolytic conditions are using non-volatile polar solvents, loss of solvents to higher temperatures is not a limitation. In addition, the cathode forms LiH or NaH along with the evolution of hydrogen gas at the anode.

Example 1

Figure 2:
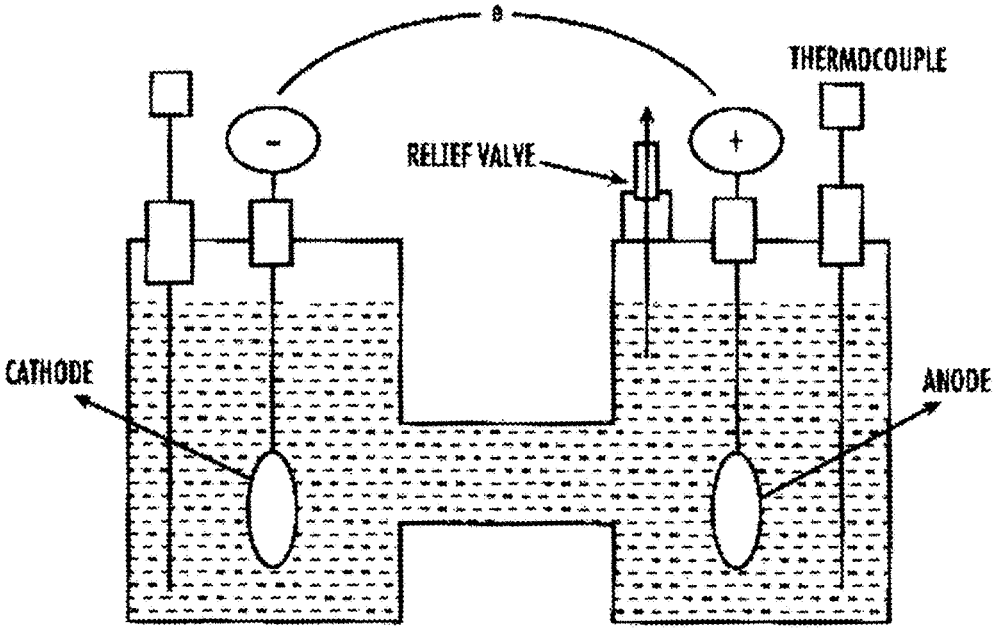
FIG. 2 is a schematic diagram of an electrolytic apparatus which may be used with a non-aqueous electrolyte to form $AlH_3$.

An electrolytic cell schematically illustrated in FIG. 2 was used to produce $AlH_3$ on a palladium anode and an aluminum cathode and an electrolyte of $NaAlH_4$ dissolved in THF. The reaction occurred at ambient pressure at room temperature using 5 v and 4 mA over a 2 hour period producing 10 mg of $AlH_3$. The formation of $AlH_3$ was detected on the anode. The formation of $AlH_3$ was confirmed using X-ray diffraction as set forth in FIG. 4.

Example 2

A high pressure electrochemical cell was utilized to generate $AlH_3$. The non-aqueous electrolyte $NaAlH_4$, dissolved in THF, was used in conjunction with a palladium anode and a platinum cathode and an electrolyte of $NaAlH_4$ dissolved in THF. The electrochemical cell was operated under an elevated hydrogen pressure of 500 psi $H_2$ and at a temperature of 60° C. using a voltage of 10 volts over a 2 hour period. 3 mg of $AlH_3$ was produced. The formation of $AlH_3$ was detected on the palladium anode and was subsequently confirmed by X-ray analysis.

Example 3

Figure 9:
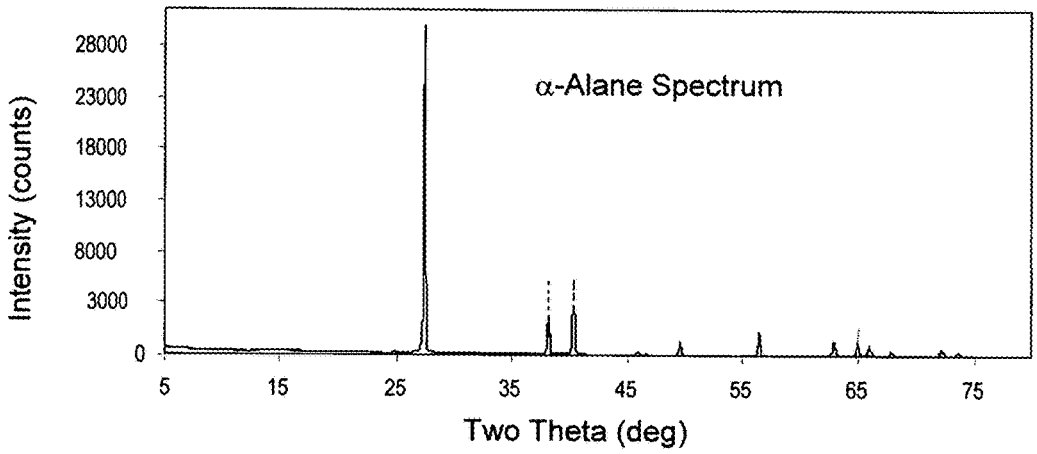
FIG. 9 is an X-ray diffraction analysis graph of alpha alane produced by an electrolysis cell.

Under ambient conditions of temperatures and pressures, using aluminum and platinum as electrodes and $LiAlH_4$ dissolved in THF, $AlH_3$ adduct was produced and alpha alane was crystallized from the adduct by heating to 70° C. under vacuum and 2 grams of the alpha alane were obtained. 1.5-2 v and 30 mA over an 8 hour time period was applied to the electrochemical cell. The pure alpha alane was confirmed by X-ray as seen in FIG. 9.

Example 4

Figure 3:
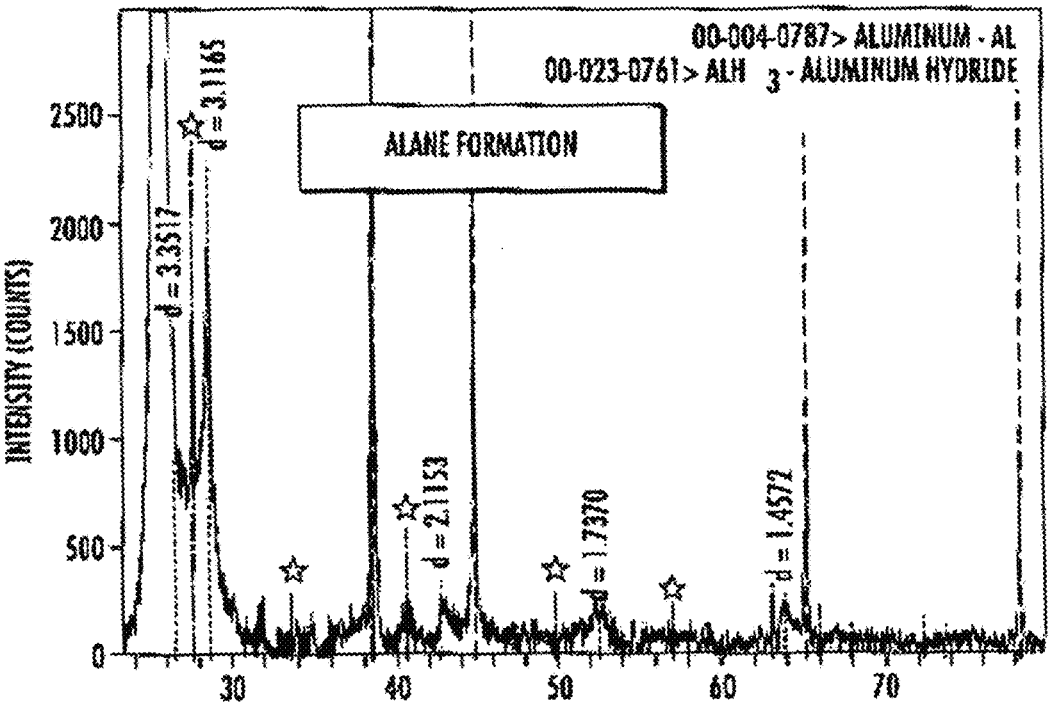
FIG. 3 is an X-ray showing diffraction analysis graph of $AlH_3$ produced by an electrochemical cell.
Figure 4:
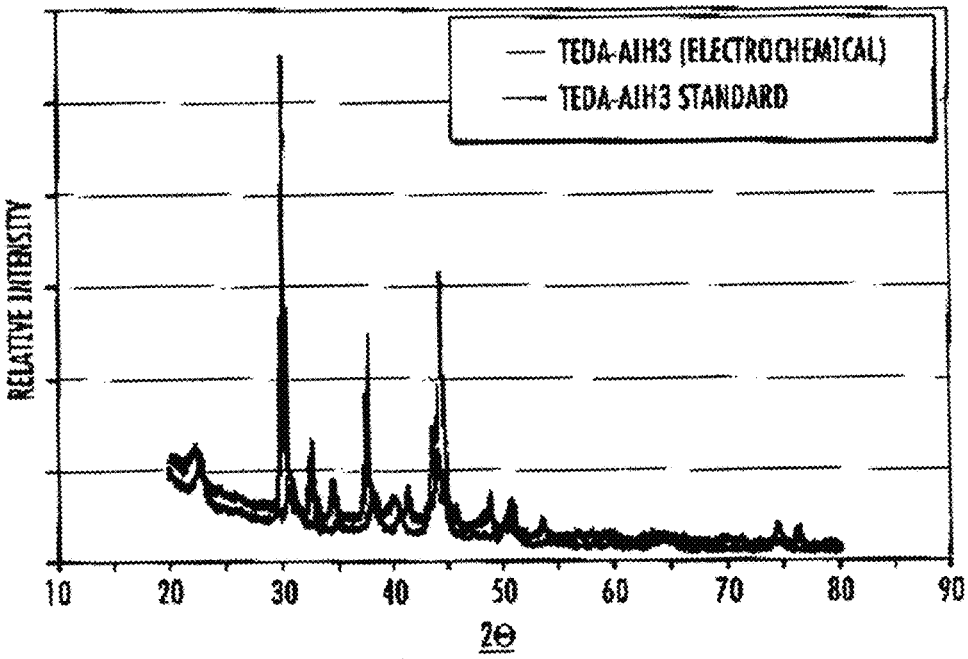
FIG. 4 is an X-ray diffraction analysis graph of $AlH_3$-TEDA produced by an electrolytic cell.

As seen in reference to FIG. 3, an $AlH_3$ Amine adduct was made using an electrochemical cell to generate $AlH_3$-triethylenediamine ($AlH_3$-TEDA). The electrolyte was made using $NaAlH_4$ and THF which was mixed with TEDA dissolved in THF, the combination being used as the electrolyte with a platinum electrode as the cathode and an aluminum electrode as the anode. Using ambient pressure and room temperature and operating conditions of 1.5 v and 30 mA over an 8 hour time period, 10 gm of $AlH_3$-TEDA were precipitated out of solution. The x-ray diffraction pattern set forth in FIG. 4 shows the recovered product produced by the electrochemical process in comparison to a standard obtained through conventional methodologies. The additional peaks of the competitive standard represent aluminum and $LiAlH_4$ which are not present in the electrochemically produced $AlH_3$-TEDA.

The $AlH_3$-TEDA made by conventional methodologies is known to be a desirable hydrogen storage material in that the material can store 2.7 times its weight at 88° C. as reported by J. Gretz et al in the *J. Phys. Chem.* 2000, Vol. 111, page 19148.

As seen in reference to FIGS. 1, 3 and 9 and the Examples provided, set forth the ability to use an electrochemical cell having dissolved $NaAlH_4$ as an electrolyte, to subsequently form $AlH_3$. The process allows for the desirable production of a reliable source of $AlH_3$ as part of a cyclic process loop. The $AlH_3$ product can be used to generate hydrogen gas for automotive or other commercial purposes. The resulting aluminum metal (spent aluminum) can be combined with NaH and hydrogen in the presence of a titanium catalyst to regenerate $NaAlH_4$ as is known in the art and as set forth and described in the following publications.

B. Bogdanovic and M. Schwickardi. *J. Alloys Comp.* 253-254 (1997);

C. M. Jensen, R. Zidan, N. Mariels, A. Hee and C. Hagen. *Int. J. Hydrogen Energy* 24 (1999), p. 461;

R. A. Zidan, S. Takara, A. G. Hee and C. M. Jensen. J. Alloys Comp. 285 (1999), p. 119;

C. M. Jensen, R. A. Zidan, U.S. Pat. No. 6,471,935 (2002); and

B. Bogdanovic, R. A. Brand, A. Marjanovic, M. Schwickardi and J. Tölle. *J. Alloys Comp.* 302 (2000), p. 36;

all of the above publications are incorporated herein by reference for all purposes.

As seen in reference to FIG. 1, the entire process loop results in no unused byproducts, but provides for a closed system. The aluminum metal may be again converted into $AlH_3$. Since no byproducts are produced, there is little waste associated with the process.

The ability to generate $AlH_3$ has been demonstrated using a non-aqueous solvent under both ambient conditions and elevated pressure and temperature conditions. While aluminum or palladium anodes and platinum or palladium hydride cathodes were utilized in the experiments, it is believed that other material choices for anodes and cathodes may be used.

For instance, suitable anodes provided by palladium, titanium, zirconium, and other hydride forming metals are suitable for forming $AlH_3$, borohydrides, and other alanates and complex hydrides. Likewise, suitable cathodes include materials such as platinum or a metallic hydride such as palladium hydride or titanium hydride. Where platinum is used as the cathode, it is noted that hydrogen gas is evolved from the surface of the cathode.

In addition, it is believed that without undue experimentation, one having ordinary skill in the art can evaluate various process conditions for the electrolytic cell so as to optimize the production of $AlH_3$ using various combinations of voltage, operating temperature, and operating pressure. It is also understood that the ability to regenerate aluminum into aluminum hydride holds enormous possibilities as a fuel source of hydrogen for transportation needs. Accordingly, it is recognized that within an overall energy budget, the most desirable operating conditions for generating $AlH_3$ in the electrolytic system described above may be under conditions that may not achieve the highest yield, but does achieve a commercial product in the most cost effective manner.

It is envisioned that the $AlH_3$ can be provided to the automotive industry for use as a hydrogen source at various supply stations. The spent aluminum metal may be collected and subsequently treated at a commercial facility to regenerate the aluminum metal into an $AlH_3$ using the polar, non-aqueous electrochemical cell. Depending upon the processing facility, the electrolytic cell may be operated under high pressure and/or high temperature conditions so as to generate a more favorable reaction rate.

The methodology reported herein is not limited to the specific electrolyte and specific electrodes. For instance, a variety of aluminum etherates such as Al-TEA and boronates such as $LiBH_4$-TEDA and other borohydride adducts may be employed. The electrochemical methodology described herein is a new method of making organo-metallic hydrides such as $AlH_3$-TEDA or $Al(BH_4)_3$-TEDA or other MH-Amine combinations where M is a metal that can have application in hydrogen storage for the automotive industry and portable energy systems such as batteries and fuel cells. The methodology lends itself to economical charging and re-charging systems as part of a renewable fuel cell.

Heretofore, electrolytic processes involving the formation of alanes and other complex hydrides involve the use of salt containing electrolytic solutions, which are detrimental to the desired pathway described herein. In comparison, the present chemical formation process has a very high yield in that there are no competing side reactions that result in undesired end products.

An additional variation of the methods reported herein include the use of an electo-catalytic-additive (ECA) which has been found useful in enhancing the yield of the electrochemical method for producing and generating alanes.

The electrochemical method for producing and regenerating alane is highly enhanced by the use of an Electo-Catalytic-Additive (ECA). The ECA is an additive made of a halide (e.g. MX, M=Li, Na and X=F, Cl, Br and I) dissolved in a polar solvent.

The electrolysis is carried out in an electrochemically stable, aprotic, and polar solvent such as THF or ether. $MAlH_4$ (M=Li, Na) is dissolved in a polar solvent, forming an ionic solution. For example, lithium alanates dissolved in THF is used as an electrolyte.

$$LiAlH_4/THF \leftrightarrow Li^+/AlH_4^-/THF \quad (1)$$

The reaction in the electrochemical cell without the ECA can be described as such At the Anode:

$$AlH_4^- \rightarrow AlH_3.nTHF + \tfrac{1}{2}H_2\uparrow + + e^- \quad (2)$$

Or $$3AlH_4^- + Al\ (Anode) \rightarrow 4AlH_3.nTHF + 3e^{-\square} \quad (3)$$

At the cathode:

$$Li^+ + PdH\ (Cathode) + e^+ \rightarrow LiH + Pd \quad (4)$$

When LiCl is added in THF, for example, to the electrolyte in equation 1

In addition to the electrolyte described in equation 11 the ionic electrolyte solution will contain $$LiCl/THF \leftrightarrow Li^+/Cl^-/THF \quad (5)$$

At the Anode:

$$3Cl + Al\ (Anode) \rightarrow AlCl_3 + 3e^- \quad (6)$$

At the cathode:

$$Li^+ + PdH\ (Cathode) + e^- \rightarrow LiH + Pd \quad (7)$$

However, the formation of $AlCl_3$ at the aluminum electrode will lead to the following reaction producing more alane ($AlH_3$)

$$3LiAlH_4 + AlCl_3 \rightarrow 4AlH_3 + 3LiCl \quad (8)$$

The LiCl dissolves back in THF as in equation (5) and the cycle continues till all the $LiAlH_4$ is converted into $AlH_3$.

Figure 5:
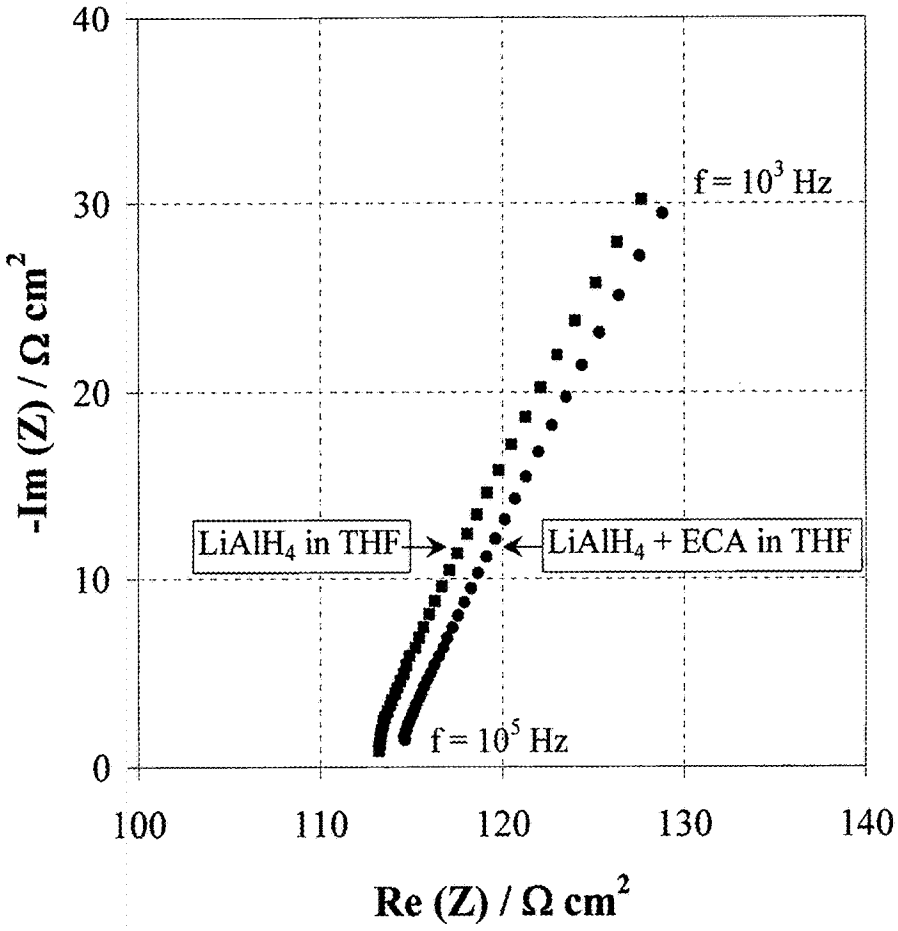
FIG. 5 is a comparative graph showing formation of $AlH_3$-TEDA with and without the ECA additive.

The same concept applies to other halides and other and different solvent such as etherates Experimental Verification of ECA Test 1:

To test the effect of the ECA two cells were prepared using $LiAlH_4$ and TEDA in THF and including the ECA (1 gm of LiCl) in one of the cells. TEDA was incorporated in the solution to visually detect the formation of alane as $AlH_3$-TEDA (white precipitate) during the experimental test. $AlH_3$-TEDA was easily separated by filtering and then weighed. FIG. 5 shows the initial state of each cell and after 10 min of electrolysis. This figure clearly shows that cell 2 (cell with ECA in FIG. 6D) contains a larger amount of $AlH_3$-TEDA. Also, it should be notice that a minimal amount or no dendrites were produced in the counter electrode in either cell.

Figure 6B:
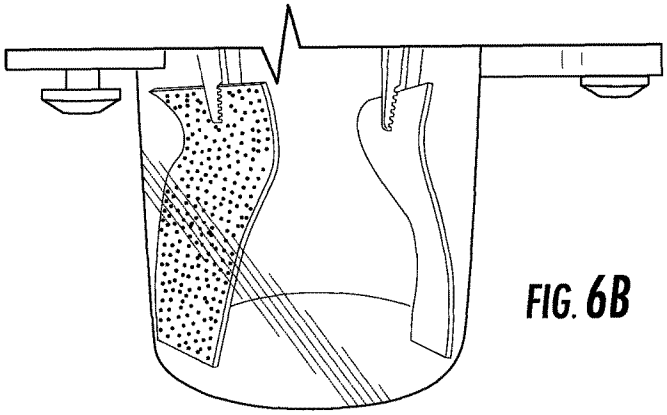
FIGS. 6A-6D are photograph comparisons of the buk electrolysis of production of $AlH_3$-TEDA using comparative electrochemical cells with (6D) and without (6B) the ECA.
Figure 6D:
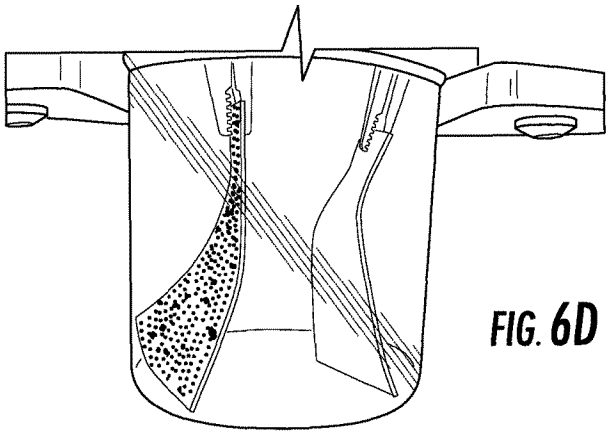
Figure 6A:
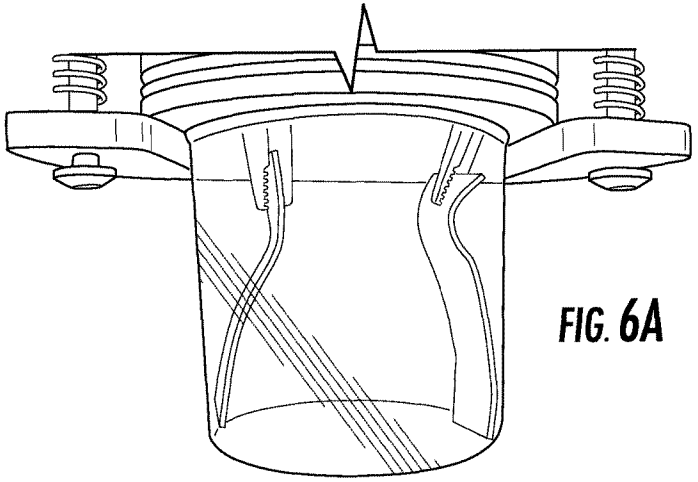
Figure 6C:
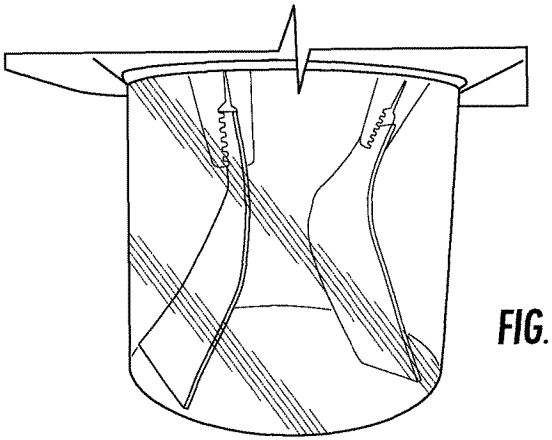
Figure 7:
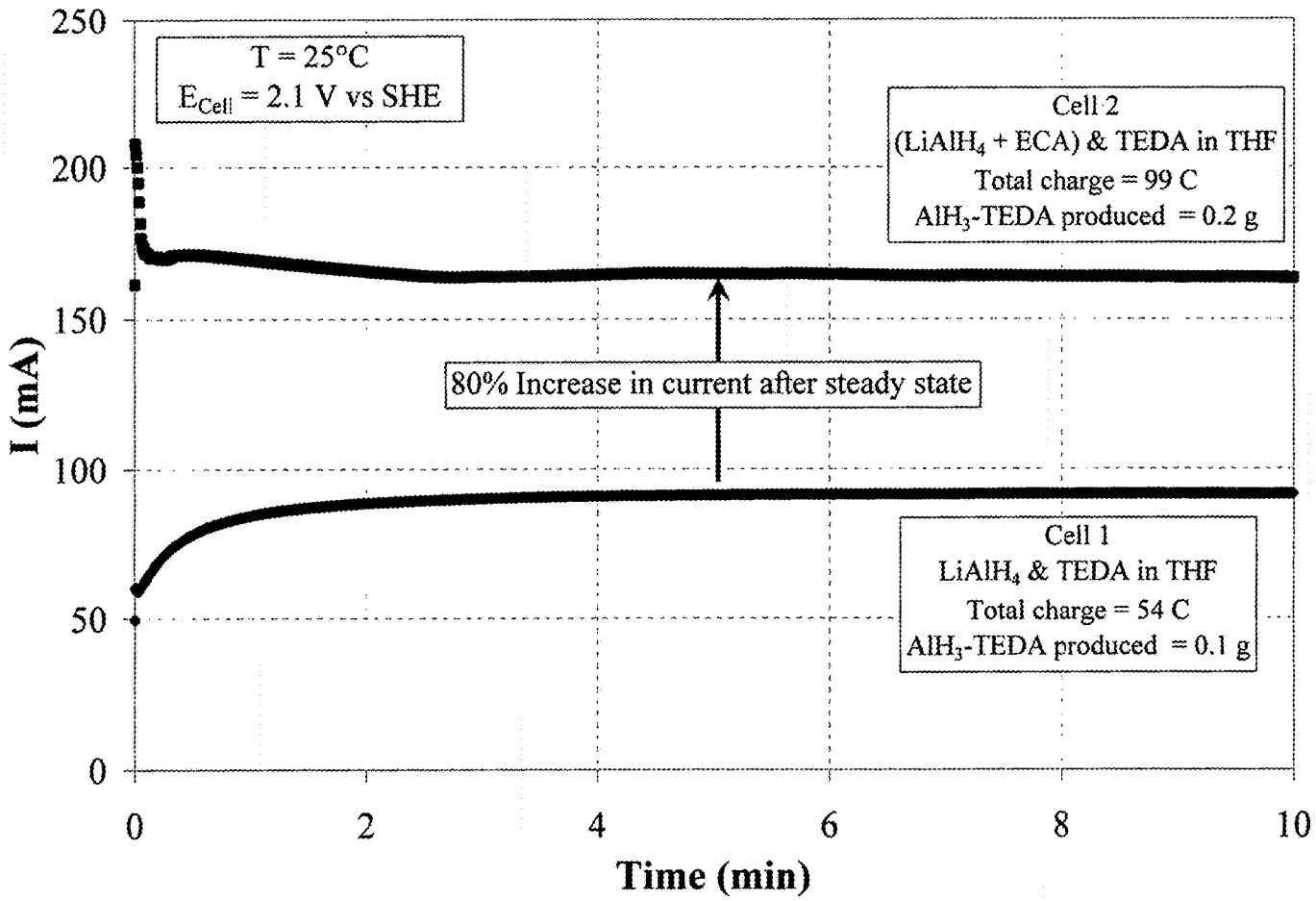
FIG. 7 is a comparison of the circuit voltage performed on the two electrochemical cells with and without the ECA.

FIG. 6 shows the production of $AlH_3$-TEDA formation (FIG. 6B) in a cell without ECA and results of an increased yield with the ECA additive present as seen in FIG. 6D. Respective controls of 6A and 6C indicate the condition of the electrodes prior to 10 min of electrolysis at 2.1 V. The high potential used during the electrolysis was required to produce enough alane in those 10 min for visualization purpose and eventually yield comparison. This figure shows an increase of 80% in the current when the ECA was used. The total charge for cell 2 was twice the total charge obtained with cell 1. The amount of yield of $AlH_3$-TEDA was doubled when the ECA was used on cell 2. CVs for both cells are presented in FIG. 7. It should be noted that the open circuit voltage (OCV) for cell 2 is shifted to −1.5 V from the original cell #1 (OCV=−1.9). This means that the overpotential required for cell 2 is less when performing the electrolysis at 2.1 V. Consequently, lower energy is required for cell 2 to produce $AlH_3$-TEDA, which implies that cell 2 is more efficient because it has more current with less energy input.

Figure 8:
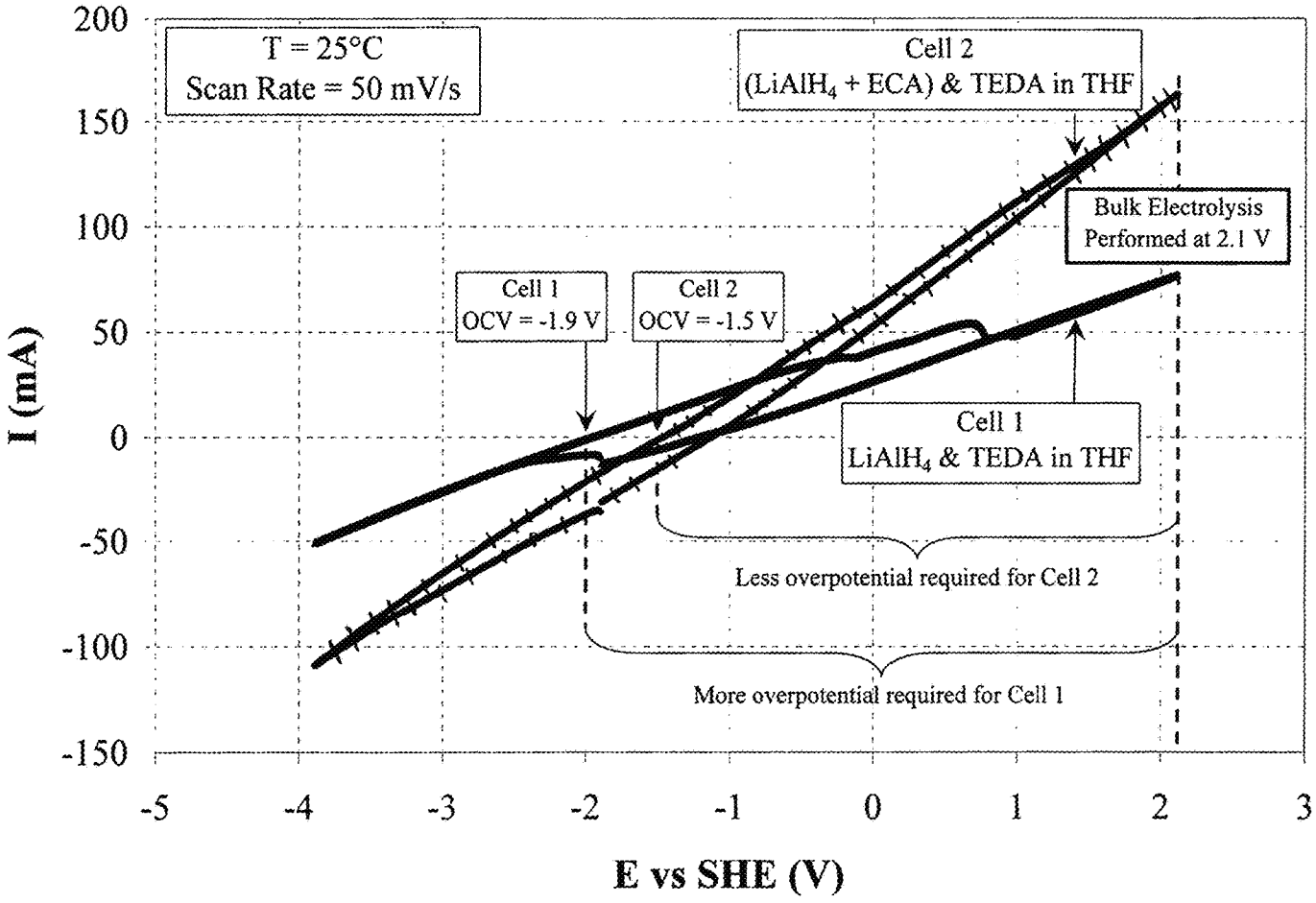
FIG. 8 is a comparison of the electrochemical and impedance stectroscopy on two electrochemical cells with and without the ECA.

Electrochemical Impedance Spectroscopy (EIS) was performed on the cells with and without the ECA. FIG. 8 shows that of the impedance, which represents the resistance of the cells, is about 112 $Wcm^2$ for both cells. This shows that the ECA does not have a significant effect in the resistance (or conductivity) of the solution. That is, the ECA is not acting as an electrolyte. Consequently, the increase in current and efficiency discussed above are an electro-catalytic effect of the ECA.

Electrochemical Cell Preparation and Tests

Test 2:

The electrochemical cells were prepared in an argon environment. Solutions from Sigma Aldrich consisting of 100-200 mL of 1 M $MAlH_4$ (M=Na, Li) in THF or $Et_2O$ (except $NaAlH_4$ in $Et_2O$ due to poor solubility) were used. The working electrode (anode) was an aluminum sheet of 1.56 $cm^2$ (Alfa Aesar) and the counter electrode (cathode) was a platinum foil of 6.25 $cm^2$ (Alfa Aesar). Prior to the experiments, the aluminum electrode was sanded in an inert environment to remove as much of the oxide layer as possible. A "leak-free" 3M KCl Ag/AgCl (Warner Instruments) was used as reference electrode.

Preparation of the electrochemical cells to test the ECA was similar as described above, except that larger electrodes were employed and aluminum was also used as the counter electrode. In addition, about 1 g of LiCl was used in the cell for the test of the ECA and TEDA was added for visualization of the alane as $AlH_3$-TEDA.

Experiments were performed by attaching the electrochemical cell to a Schlenk line and were carried out at room temperature and atmospheric pressure. Electrochemical impedance spectroscopy (EIS), cyclic voltammograms (CV) and bulk electrolysis were performed using a Bio Logic VMP3 potentiostat. The impedance spectra were recorded using an amplitude of 20 mV around open circuit. The CVs were measured for 3 cycles at a scan rate of 10 mV/s or 50 mV/s.

Characterization

To confirm that alane was produced in the electrochemical cell of $LiAlH_4$-$Et_2O$, TEDA was used to precipitate the alane as $AlH_3$-TEDA. For this, 70 mg of TEDA was added to 10 mL of THF and stirred until all solid was dissolved. Then this solution was added to 20 mL of the $AlH_3/Et_2O$ solution collected from the electrochemical cell. The solid (formed immediately) was collected by filtration followed by a wash with two 20 mL aliquots of THF to remove any residual TEDA. The remaining solid was dried under vacuum for 24 hours. IR spectra and XRD of this sample are shown in FIGS. 10 and 11 respectively.

The CVs for the electrochemical cells with $MAlH_4$ (M=Na, Li) in THF and $EtO_2$ show different oxidation and reduction reactions occurring in the system. The possible half-reactions with their respective equilibrium potentials for the cells are shown in Table 1. Although these values represent the potentials in aqueous solutions they give an approximation of the overpotentials at which these reactions can occurs. In general, the difference between the Na-related reactions and the analogous Li-related reactions is a potential shift of −0.28 to −0.33 V, except for the reactions (4) and (9) which has a shift of 0.04 V. However, the CVs show that the potentials between the $NaAlH_4$-THF and $LiAlH_4$-$EtO_2$ cells are not shifted producing similar CVs with different current magnitude due to the difference in cell resistances.

TABLE 1

Reduction potentials for the electrochemical cell reactions.

| Reactions | $E^0$ (V) vs SHE | Eq. No. |
|---|---|---|
| $4AlH_3 + 3Na^+ + 3e^- \leftrightarrow 3NaAlH_4 + Al$ | −1.57 | (1) |
| $AlH_3 + ½H_2 + Na^+ + e^- \leftrightarrow NaAlH_4$ | −1.73 | (2) |
| $Al + 2H_2 + Na^+ + e^- \leftrightarrow NaAlH_4$ | −2.28 | (3) |
| $½H_2 + Na^+ + e^- \leftrightarrow NaH$ | −2.37 | (4) |
| $Na^+ + e^- \leftrightarrow Na$ | −2.71 | (5) |
| $4AlH_3 + 3Li^+ + 3e^- \leftrightarrow 3LiAlH_4 + Al$ | −1.89 | (6) |
| $AlH_3 + ½H_2 + Li^+ + e^- \leftrightarrow LiAlH_4$ | −2.05 | (7) |
| $Al + 2H_2 + Li^+ + e^- \leftrightarrow LiAlH_4$ | −2.56 | (8) |
| $½H_2 + Li^+ + e^- \leftrightarrow LiH$ | −2.33 | (9) |
| $Li^+ + e^- \leftrightarrow Li$ | −3.04 | (10) |

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

That which is claimed:

1. An electrochemical process of producing $AlH_3$ comprising:

supplying an anode;

supplying a cathode;

placing said anode and said cathode in an electrolytic solution consisting of THF, an electro-catalytic-additive wherein said electrode-catalytic additive is a halide according to the formula MX where M is Li or Na and X is F, Cl, Br, or I, and an electrolyte selected from the group consisting of $NaAlH_4$, $LiAlH_4$, $KAlH_4$, triethylenediamines, aluminum etherates, and combinations thereof, wherein the electro-catalytic-additive does not act as an electrolyte within the electrolytic solution by having no significant effect on resistance or conductivity of the electrolytic solution; and passing a current through the electrochemical cell to form an alane adduct, with the electro-catalytic-additive increasing the current passing through the electrochemical cell thereby increasing an efficiency in the formation in the alane adduct; and recovering $AlH_3$ from the alane adduct.

2. The process according to claim 1 wherein said anode is an aluminum or palladium anode.

3. The process according to claim 1 wherein said cathode is a platinum or palladium hydride cathode.

4. The process according to claim 1 comprising the additional step of removing $AlH_3$ from a surface of said anode.

5. The process according to claim 1 wherein said cathode is platinum and, atomization of hydrogen occurs at said cathode.

6. The process according to claim 1 wherein anode is an aluminum and said cathode is platinum and the electrolyte comprises $NaAlH_4$ and a triethylenediamine to generate $AlH_3$-triethylenediamine.

7. The electrochemical process of producing $AlH_3$ comprising:

supplying an anode selected from the materials of palladium, titanium, zirconium, aluminum, magnesium, calcium, or hydride forming metals;

supplying a cathode selected from platinum or a metallic hydride;

recovering aluminum from dehydrided $AlH_3$;

forming $LiAlH_4$ from direct hydrogenation of the recovered aluminum;

placing said anode and said cathode in an electrolytic solution consisting essentially of THF, an electro-catalytic-additive wherein said electrode-catalytic additive is a halide according to the formula MX where M is Li or Na and X is F, Cl, Br, or I, and the formed $LiAlH_4$, wherein the electro-catalytic-additive does not act as an electrolyte within the electrolytic solution by having no significant effect on resistance or conductivity of the electrolytic solution;

passing a current through the electrochemical cell to form $AlH_3$ adduct with the electro-catalytic-additive increasing the current passing through the electrochemical cell thereby increasing an efficiency in the formation in the $AlH_3$ adduct; and, heating the $AlH_3$ adduct in a vacuum and thereby recovering $AlH_3$.

8. An electrochemical process of producing an alane comprising:

supplying an, anode selected from the materials of palladium, titanium, zirconium, aluminum, magnesium, calcium, and, combinations thereof;

supplying a cathode selected from the materials of platinum, a metallic hydride, and combinations thereof;

placing said anode and said cathode in an electrolytic solution consisting essentially of THF, an electro-catalytic-additive wherein said electrode-catalytic additive is a halide according to the formula MX where M is Li or Na and X is F, Cl, Br, or I, and an electrolyte selected from the group consisting of $NaAlH_4$, $LiAlH_4$, $KAlH_4$, triethylenediamines, aluminum etherates, and combinations thereof, wherein the electro-catalytic-additive does not act as an electrolyte within the electrolytic solution by having no significant effect on resistance or conductivity of the electrolytic solution; and passing a current through the electrochemical cell to form an alane adduct with the electro-catalytic-additive increasing the current passing through the electrochemical cell thereby increasing an efficiency in the formation in the alane adduct.

9. The process according to claim 8 further comprising forming $LiAlH_4$ from a dehydrided $AlH_3$, wherein the electrolyte in said electrolytic solution is $LiAlH_4$.

10. The process according to claim 8 wherein said cathode is platinum and, atomization of hydrogen occurs at said cathode.

* * * * *